US007754308B2

(12) United States Patent
Koch et al.

(10) Patent No.: US 7,754,308 B2
(45) Date of Patent: Jul. 13, 2010

(54) ARTIFICIAL TURF SYSTEMS HAVING A VULCANISED THERMOPLASTIC ELASTOMER OR STYRENE-ETHYLENE-BUTADIENE-STYRENE POLYMER AS INFILL MATERIAL

(75) Inventors: Michael Henri Koch, Simpelveld (NL); Martinus Maaren Van, Born (NL)

(73) Assignee: So.F.Ter S.p.A., Forlì (IT)

( * ) Notice: Subject to any disclaimer, the term of this patent is extended or adjusted under 35 U.S.C. 154(b) by 857 days.

(21) Appl. No.: 10/578,862

(22) PCT Filed: Nov. 11, 2004

(86) PCT No.: PCT/EP2004/012903

§ 371 (c)(1),
(2), (4) Date: Oct. 11, 2006

(87) PCT Pub. No.: WO2005/047602

PCT Pub. Date: May 26, 2005

(65) Prior Publication Data

US 2007/0049694 A1 Mar. 1, 2007

(30) Foreign Application Priority Data

Nov. 13, 2003 (EP) ..... 03078572

(51) Int. Cl.
*D04H 11/00* (2006.01)

(52) U.S. Cl. ..... 428/87; 428/92; 428/95; 428/96; 428/97

(58) Field of Classification Search ..... 428/87, 428/92, 95, 96, 97
See application file for complete search history.

(56) References Cited

U.S. PATENT DOCUMENTS

| | | | | |
|---|---|---|---|---|
| 6,299,959 | B1 | 10/2001 | Squires et al. | |
| 6,723,413 | B2 * | 4/2004 | Walters | 428/95 |
| 7,399,514 | B2 * | 7/2008 | De Clerck | 428/92 |

FOREIGN PATENT DOCUMENTS

| | | | |
|---|---|---|---|
| EP | 1 158 099 | A2 | 11/2001 |
| EP | 1 386 944 | A1 | 2/2004 |
| JP | 2001020139 | | 1/2001 |
| WO | 2004/077914 | A2 | 9/2004 |

OTHER PUBLICATIONS

International Search Report.
International Search Report.

* cited by examiner

*Primary Examiner*—Bernard Lipman
(74) *Attorney, Agent, or Firm*—Modiano & Associati; Albert Josif; Daniel J. O'Byrne

(57) ABSTRACT

The present invention relates to the use of a vulcanised thermoplastic elastomer or styrene-ethylene-butadiene-styrene polymer (SEBS) as infill material in artificial turf systems. Artificial turf has achieved growing popularity in recent years, particularly for football fields. The vulcanised thermoplastic elastomer comprises a polyolefin and a rubber wherein the rubber is dynamically vulcanised by the use of a curing agent. The polyolefin is chosen from polyethylene or polypropylene and the rubber is chosen from EPDM or EPM. The rubber is dynamically vulcanised by a curing agent chosen from sulfur, sulfurous compounds, metal oxides, maleimides, phenol resins, silanes or peroxides.

8 Claims, No Drawings

ARTIFICIAL TURF SYSTEMS HAVING A VULCANISED THERMOPLASTIC ELASTOMER OR STYRENE-ETHYLENE-BUTADIENE-STYRENE POLYMER AS INFILL MATERIAL

This application is the US national phase of international application PCT/EP2004/012903 filed 11 Nov. 2004 which designated the U.S. and claims benefit of EP 03078572.9, dated 13 Nov. 2003, the entire content of which is hereby incorporated by reference.

The present invention relates to the use of elastomer materials as infill material in artificial turf systems.

Artificial turf has achieved growing popularity in recent years, particularly for football fields. An important reason for this trend is a new generation of artificial-turf systems, in which fibres with low sliding resistance are utilised in combination with elastomer material as infill material. Rubber particles are well known as infill material. Over the last two years those artificial turf systems, for example artificial grass, have been further improved using new developments in fibre technology, tuft technology and total system installations. The rubber particles which are used as rubber infill materials have a significant influence on the total system and its performance.

In the majority of cases the rubber infill materials of the artificial turf systems have been produced from recycled rubber from tyres. However one of the disadvantages of the use of recycled rubbers from tyres, in for example artificial grasses for football fields, is the warming up of the rubber infill material during sunny weather. The black coloured rubber infill can reach temperatures of 70° C. Because of the low heat transfer of the rubber infill material football players can get unnaturally warm, which can be very uncomfortable. Another disadvantage of the use of recycled rubbers from tyres is an environmental risk of leaching aromatic and/or heavy metals into the ground or groundwater.

The object of the present invention is to provide an infill material for artificial turf systems not showing the above described disadvantages. This object is achieved by the use of a vulcanised thermoplastic elastomer or styrene-ethylene-butadiene-styrene polymer (SEBS) as infill material in artificial turf systems.

Surprisingly, it has been found that the use of the vulcanised thermoplastic elastomer (TPV) or the styrene-ethylene-butadiene-styrene polymer (SEBS) as infill material in artificial turf systems, such as for example artificial grass shows no leaching of aromatic oils which results in a reduced environmental risk. Moreover the vulcanised thermoplastic elastomer can be produced in different colours for example in beige, green or brown. The beige colour for example leads to lower temperatures during hot summer conditions. At 30° C. for example the temperature of beige coloured TPV based infill material is 20° C. lower than black rubber infill material. Another advantage is an improved UV stability. Still another advantage is that it is possible to produce round TPV or SEBS infill particles which reduces friction.

SEBS is commercially available from Shell Chemical Company under the trademark KRATON G. The SEBS infill material may comprise mixtures with polyolefines.

The vulcanised thermoplastic elastomer comprises a polyolefin and a rubber wherein the rubber is vulcanised by the use of a curing agent.

Examples of the polyolefin are homopolymers of ethylene or propylene, copolymers of ethylene and propylene, copolymers of ethylene and an alpha-olefin comonomer with 4-20 carbon atoms or copolymers of propylene and an alpha-olefin comonomer with 4-20 carbon atoms. In case of a copolymer, the content of propylene in said copolymer is preferably at least 75 wt. %. The polyolefin homo- and copolymers may be prepared with a Ziegler-Natta catalyst, a metallocene catalyst or with another single site catalyst. Preferably, polypropylene, polyethylene or mixtures thereof are used as polyolefin. More preferably polypropylene is used as polyolefin. The polypropylene may be linear or branched. Preferably a linear polypropylene is used. The Melt flow index (MFI) of the polypropylene preferably is between 0.1 and 50; more preferably between 0.3-20 (according to ISO standard 1133 (measured at 230° C.; with 2.16 kg load)).

The amount of polyolefine is generally from about 5 to about 95 weight percent based on the total weight of the vulcanised thermoplastic elastomer. Preferably the amount will vary from about 10 to about 70 weight percent based on the total weight of the vulcanised thermoplastic elastomer.

More preferably the amount may vary from about 15 to about 60 weight percent based on the total weight of the vulcanised thermoplastic elastomer.

Examples of rubbers that are suitable are ethylene-propylene copolymers, hereinafter called EPM, ethylene-propylene-diene terpolymers, hereinafter called EPDM, styrene butadiene rubber, nitrile butadiene rubber, isobutene-isoprene rubber, styrene-ethylene/styrene-butadiene block copolymers, butyl rubber, isobutylene-p-methylstyrene copolymers or brominated isobutylene-p-methylstyrene copolymers, natural rubber or blends of these.

Preferably, EPDM or EPM is used as rubber. Most preferably, EPDM is used as rubber. The EPDM preferably contains 50-70 parts by weight ethylene monomer units, 48-30 parts by weight monomer units originating from an alpha-olefin and 2-12 parts by weight monomer units originating from a non-conjugated diene. As alpha-olefin use is preferably made of propylene. As non-conjugated diene use is preferably made of dicyclopentadiene (DCPD), 5-ethylidene-2-norbornene (ENB) or vinylnorbornene (VNB). The amount of rubber generally ranges from about 95 to 5 weight percent based on the weight of the rubber and the polyolefine. Preferably the amount of rubber may vary from about 90 to about 30 weight percent based on the total weight of the vulcanised thermoplastic elastomer. More preferably the amount may vary from about 85 to about 40 weight percent based on the total weight of the vulcanised thermoplastic elastomer.

The rubber is vulcanised in the presence of a curing agent, for example sulfur, sulfurous compounds, metal oxides, maleimides, phenol resins, silanes or peroxides. These curing agents are known from the state of the art and are described in for example U.S. Pat. No. 5,100,947. The rubber is preferably dynamically vulcanised. Preferably peroxides are used as curing agent. Examples of suitable peroxides are organic peroxides for example dicumyl peroxide, di-tert-butylperoxide, 2,5-dimethyl-(2,5-di-tert-butylperoxy)hexane, 1,3-bis(tert-butylperoxyisopropyl)benzene, 1,1-bis(tert-butylperoxy)-2,3,5-trimethylcyclohexane, benzoyl peroxide, 2,4-dichlorobenzoyl peroxide, tert-butyl peroxybenzoate, tert-butyl peroxyisopropylcarbonate, diacetyl peroxide, lauroyl peroxide, tert-butyl cumyl peroxide.

The amount of peroxide is preferably between 0.02-5% by weight and more preferably between 0.05-2% by weight relative to the total weight of the thermoplastic elastomer.

The degree of vulcanization of the rubber can be expressed in terms of a gel content. A gel content is the ratio of the amount of non-soluble rubber and the total amount of rubber (in weight) of a specimen soaked in an organic solvent for the rubber. A method for measuring the gel content is described in U.S. Pat. No. 5,100,947. Herein a specimen is soaked for 48 hours in an organic solvent for the rubber at room temperature. After weighing of both the specimen before soaking and its residue, the amount of non-soluble elastomer and total elastomer can be calculated, based on knowledge of the relative amounts of all components in the thermoplastic elastomer composition. The rubber in the vulcanised thermoplastic elastomer is at least partly vulcanised and for instance has a gel content between 60 and 100%.

Preferably the rubber is vulcanised to a gel content higher than 70%. More preferably to a gel content higher than 90%. Even more preferably the rubber is vulcanised to a gel content of at least 95%. Most preferably the rubber is vulcanised to a gel content of about 100%.

The vulcanised thermoplastic elastomer can be prepared by melt mixing and kneading the polyolefin, the rubber and optionally additives customarily employed by one skilled in the art. Melt mixing and kneading may be carried out in conventional mixing equipment for example roll mills, Banbury mixers, Brabender mixers, continuous mixers for example a single screw extruder, a twin screw extruder and the like. Preferably, melt mixing is carried out in a twin screw extruder. After the polyolefin, the rubber and optionally additives have been properly dispersed, the curing agent is added to initiate the dynamic vulcanization. The vulcanised thermoplastic elastomer may also be prepared by melt mixing the polyolefin, the rubber and optionally additives in one step. By one step is meant that the polyolefin, the rubber, the curing agent and optionally other additives are fed by feeders to a continuous mixer at the same time. An oil may for example be added before, during or after the vulcanization. The oil may however also be added partly before and partially after the vulcanization. Preferably the oil is added after the vulcanisation. The dynamically vulcanised thermoplastic elastomer for example has hardness between 60 and 95 Shore A.

The vulcanised thermoplastic elastomer optionally contains customary additives. Examples of such additives are reinforcing and non-reinforcing fillers, plasticizers, antioxidants, stabilizers, oil, antistatic agents, waxes, foaming agents, pigments, flame retardants and other known agents and are described in the Rubber World Magazine Blue Book, and in Gaether et al., Plastics Additives Handbook (Hanser 1990). Examples of suitable fillers are calcium carbonate, clay, silica, talc, titanium dioxide, and carbon.

Examples suitable oils are paraffinic oil or naphthenic oil obtained from petroleum fractions. As paraffinic oil for example Sunpar™ oil may be used. Also highly hydrogenated oil in which the concentration of aromatic compounds is preferably less than 4 wt. % and the concentration of polar compounds is less than 0.3 wt. % may be used. An example of such oil is PennzUltra™ 1199, supplied by Pennzoil in the United States of America. Another additive that can optionally be added is a Lewis base such as for instance a metal oxide, a metal hydroxide, a metal carbonate or hydrotalcite.

The additives can optionally be added during the preparation of the vulcanised thermoplastic elastomer. The quantity of additive to be added is known to one skilled in the art.

The vulcanised thermoplastic elastomer or SEBS is used as infill material in artificial turf systems such as for example in artificial grass, that may be used for soccer fields, hockey fields or tennis fields.

The invention claimed is:

1. An artificial turf system which comprises a vulcanised thermoplastic elastomer or styrene-ethylene-butadiene-styrene polymer (SEBS) as infill material.

2. The artificial turf system according to claim 1 in the form of artificial grass.

3. The artificial turf system according to claim 1, wherein the vulcanised thermoplastic elastomer comprises a polyolefin and a rubber, and wherein the rubber is dynamically vulcanised by the use of a curing agent.

4. The artificial turf system according to claim 3 wherein the polyolefin is chosen from polyethylene or polypropylene and the rubber is chosen from ethylene-propylene-diene terpolymers (EPDM) or ethylene-propylene copolymers (EPM).

5. The artificial turf system according to claim 3, wherein the rubber is dynamically vulcanised by a curing agent chosen from sulfur, sulfurous compounds, metal oxides, maleimides, phenol resins, silanes or peroxides.

6. The artificial turf system according to claim 5, wherein the rubber is dynamically vulcanised by a peroxide.

7. The artificial turf system according to claim 3, wherein the rubber is vulcanised to a gel content higher than 70%.

8. An athletic field surface which comprises the artificial turf system according to claim 1, wherein the athletic field surface is chosen from soccer fields, hockey fields or tennis courts.

* * * * *